United States Patent [19]

Thiel

[11] Patent Number: 5,072,925

[45] Date of Patent: Dec. 17, 1991

[54] APPARATUS AND METHOD FOR AUTOMATIC REGISTRATION OF MANUALLY INSERTED PRINT MEDIA

[75] Inventor: Ronald V. Thiel, Fremont, Calif.

[73] Assignee: Apple Computer, Inc., Cupertino, Calif.

[21] Appl. No.: 521,279

[22] Filed: May 9, 1990

[51] Int. Cl.[5] ..... B65H 7/02

[52] U.S. Cl. ..... 271/227; 271/245

[58] Field of Search ..... 271/226, 227, 241, 245

[56] References Cited

U.S. PATENT DOCUMENTS 4,895,358 1/1990 Kawasaki ..... 271/121

FOREIGN PATENT DOCUMENTS 0118542 6/1985 Japan ..... 271/226
0127954 5/1988 Japan ..... 271/227
0321237 12/1989 Japan ..... 271/242
0018244 1/1990 Japan ..... 271/242

*Primary Examiner*—H. Grant Skaggs
*Assistant Examiner*—Carol Lynn Druzbick
*Attorney, Agent, or Firm*—Blakely, Sokoloff, Taylor & Zafman

[57] ABSTRACT

The present invention comprises an apparatus and method for automatically feeding manually inserted print media into a printer or similar device and substantially aligning the same, thereby eliminating the need to correct the alignment of the print media manually. The invention automatically feeds the media to the printer by means of a first paper drive having a low torque which aligns the media in the nip and then actuates the paper feed drive. The method of aligning the media is also disclosed.

18 Claims, 1 Drawing Sheet

APPARATUS AND METHOD FOR AUTOMATIC REGISTRATION OF MANUALLY INSERTED PRINT MEDIA

BACKGROUND OF THE INVENTION

1. Field of the Invention

This invention relates to an apparatus and method for manually feeding single sheets of paper into an otherwise automated printer, typewriter or similar automatic printing devices in which a drive roller advances the paper through the printer. More particularly, this invention relates to a method and apparatus for leading edge alignment of manually inserted paper prior to printing thereon.

2. Art Background

Various types of office machines including typewriters, printers, some facsimile machines, and the like, allow the manual insertion of individual sheets of paper. In the process of inserting each single sheet of paper, it is critical to the quality of the output printed page that the paper be correctly aligned before the printing operation begins. The typical method for inserting and aligning manually inserted paper in the prior art involves first inserting the paper into the printer until it engages the nip, that is, the intersection of the drive roller and an idle roller or spring finger, and thereafter, rotating the drive roller to hold the paper in place. Ideally, with careful insertion of the paper using the paper guides which are sometimes provided, the paper is substantially aligned; however, in many cases, the paper still ends up misaligned. After the paper is inserted, the drive roller is rotated which transports the paper to the printing position in alignment with the printing head. In the prior art, when the paper is transported into place, the leading edge of the paper can be visually checked for alignment against a paper guide. If the paper is not aligned it may be manually aligned with the paper guide by temporarily releasing the tension on the paper, and manually repositioning the paper to align with the paper guide. This system has the obvious drawback of being time consuming, tedious, and only as accurate as the person performing the manual alignment.

The present invention seeks to overcome the deficiencies in the prior art manual methods of paper insertion and alignment in providing an automatic paper feed and alignment device for such manually inserted paper, in accordance with the description of the invention presented below.

SUMMARY OF THE INVENTION

The present invention comprises an apparatus and method for automatic feeding of manually inserted individual printed media, such as paper, into a printer, typewriter or similar device, and substantially align the same, thereby eliminating the need to correct the alignment of said print media manually. The invention automatically feeds the media to a platen roller or other media capture and transport device such that it is aligned with the print line. The present invention preferably automatically takes the paper from the hand of the user, transports it to the drive roller and at the same time, aligns the leading edge of the paper in the nip and allows the paper to be taken up by the drive rollers while maintaining the proper alignment.

The present invention comprises a pinch roller disposed in the path of the paper to be inserted in the printer, and prior to the drive roller. The pinch roller is disposed on a motorized shaft which is driven by a low torque motor, or otherwise engaged with a slip transmission. An idle roller is disposed adjacent or touching the pinch roller. The motor driving the pinch roller is generally separately activated from the drive roller. Sensors may be used to detect the insertion of the paper in the pinch roller, to detect the positioning of the paper to the nip of the printer and/or the positioning of the paper at a point past the drive roller. A paper guide may be provided to direct the paper to the pinch roller.

In operation, the paper is inserted into the paper guide, past a sensor and up to the pinch roller. When the paper passes the sensor, the drive of the pinch roller is activated driving the paper forward to the nip where the paper stops its advancement. If the paper is skewed, the one side of the leading edge of the paper will abut the nip first and stop its forward movement. However, the driving pinch roller continues to drive the other side of the leading edge toward the nip until the other side reaches the nip and stops. As the paper is being aligned, the forward side of the leading edge slips a little in the nip in the direction away from the other side, and the paper pivots at a point inward from the leading edge, thereby allowing the other side of the leading edge to move forward and align with the first side of the leading edge. Once the leading edge of the paper is aligned against the nip, the drive pinch roller encounters resistance and the motor stalls so that the paper is not bunched in the drive path. The stall force may be set for different types of print media, or may be fixed if only a particular type of media, such as paper, is used therein. The preferred stall force for paper is about 4 ounces for paper ranging from 16 to 90 lb. The main drive roller then transports the paper through the printer with the pinch drive roller still activated for a short duration to provide positive force of the paper on the drive rollers.

The driving pinch roller can be activated by an electric eye which detects the presence of paper, as is known in the art, or may be manually actuated. The driving pinch roller is thereafter preferably deactivated, either manually or automatically, a predetermined amount of time after it is activated, or shortly after the drive roller is activated, or after the paper reaches a predetermined position after the drive roller has captured the paper.

It is an object of the present invention to provide a system for automatically feeding manually inserted print media into a typewriter, printer or the like, wherein the media will be aligned or registered properly.

It is another object of the present invention to provide a manual paper feed system to a printing device which requires minimal user interaction.

It is yet another object of the present invention to load single sheets of paper into a printer and register or deskew the same therein.

It is another object of the present invention to provide a media registration and transportation system for a variety of purposes.

These and other advantages of the present invention will be understood from the drawings described briefly below and the detailed description set forth herein.

DETAILED DESCRIPTION OF THE INVENTION

As described herein, the present invention is primarily suited as an apparatus and method for aligning manually inserted printed media in a printer. However, it can also be used for the alignment of print media in a number of other office machine devices including typewriters, facsimile machines, photocopiers and other devices which require the feeding of single pages therein. It will also be appreciated however, that the present invention is not limited to the foregoing devices, but may be used in any apparatus which requires the transport of a print media in an aligned or registered arrangement to write on said media, read from said media (such as optical character recognition, bar code or magnetic or digital optical encoding) or both writing thereto and reading therefrom.

For convenience and clarity, so that the present invention can be understood with reference to the presently preferred embodiment, the invention is described herein with reference to its use in printers.

Figure 1:
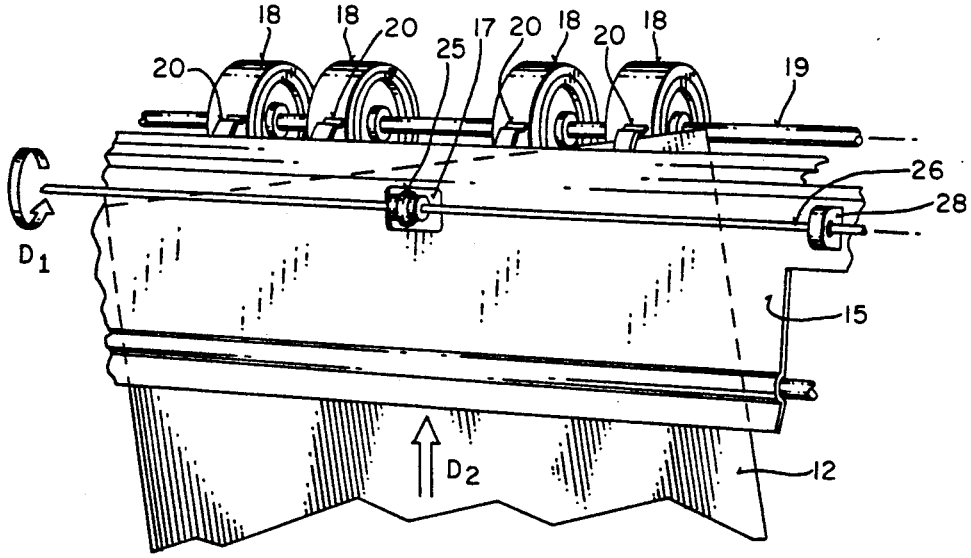
FIG. 1 is a perspective front view of the present invention.

FIG. 1 shows the present invention installed on a printer. Element 15 is a paper guide which guides the paper 12 shown in partial ghost lines where it is disposed behind paper guide 15. The main drive rollers 18, supported on motor drive shaft 19, feeds paper 12 through the printer. The spring fingers 20 abuts the roller 18 in a registered manner and a nip formed by the intersection of the fingers 20 and drive roller 18 is the line of alignment for the paper 12 which will allow proper registration thereof for printing. The angle of the spring fingers 20 to the pinch rollers 18 is preferably 45° which allows the paper 12 to be held in the nip, but also allows some lateral sliding of the paper therein so that the paper can be aligned as required.

Figure 3:
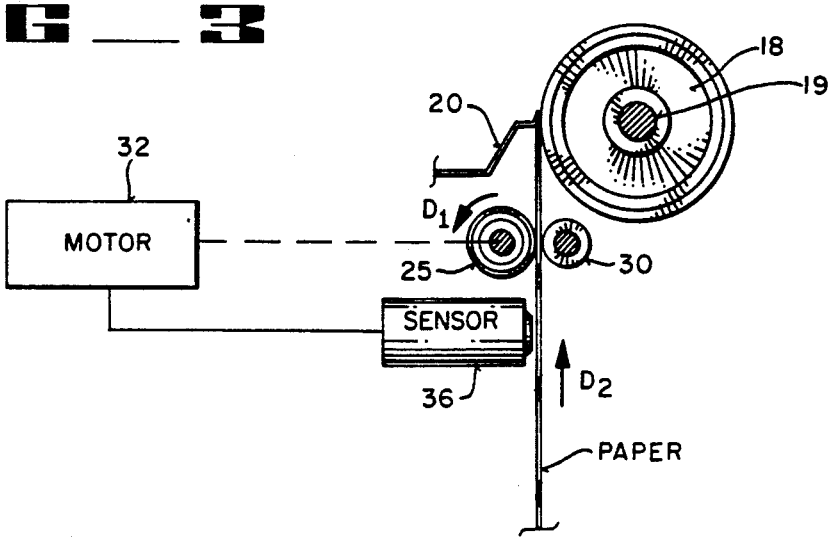
FIG. 3 is a side partially schematic view of the present invention as taken through the portion of FIG. 2 delineated by the numeral 3.

A window 17 is disposed in paper guide 15 to provide access to the paper 12 through paper guide 15, while protecting the paper 12 from the operation of the drive pinch roller 25 and shaft 26. A second engaging pinch roller 30 as shown in FIG. 3, is eliminated from FIG. 1 for clarity. The drive pinch roller 25 is mounted on shaft 26 which is motorized for the rotation in direction shown by arrow $D_1$ to transport the paper 12 toward the main rollers 20 in the direction shown by arrow $D_2$.

The drive pinch roller 25 is driven by motor 32, shown in FIG. 3, which is preferably a very low-torque drive providing a force of about 4 ounces which would not create a risk that the paper will be bunched or crushed if standard paper is used. The pinch roller has a diameter of about ½ inch in the preferred embodiment, and the motor is directly linked to the pinch roller, and has a preferred speed of about 2000 rpm, although the actual speed is somewhat a matter of preference and feel. It is possible for the pinch roller to drive the paper too quickly thereby forcing it through the nip without aligning the same. The low torque design of the motor allows the motor to stall if sufficient force is provided to the pinch roller, thereby preventing the invention from bunching or creasing the paper in use.

In the preferred embodiment the portion of the pinch roller 25 which contacts the paper is an O-ring 33 or similar construction which has a small profile or footprint but which has the ability to clearly grasp and drive the paper 12. The small footprint of the O-ring 33 on paper 12 is important in providing minimal resistance to the rotation of the paper as described below.

Figure 2:
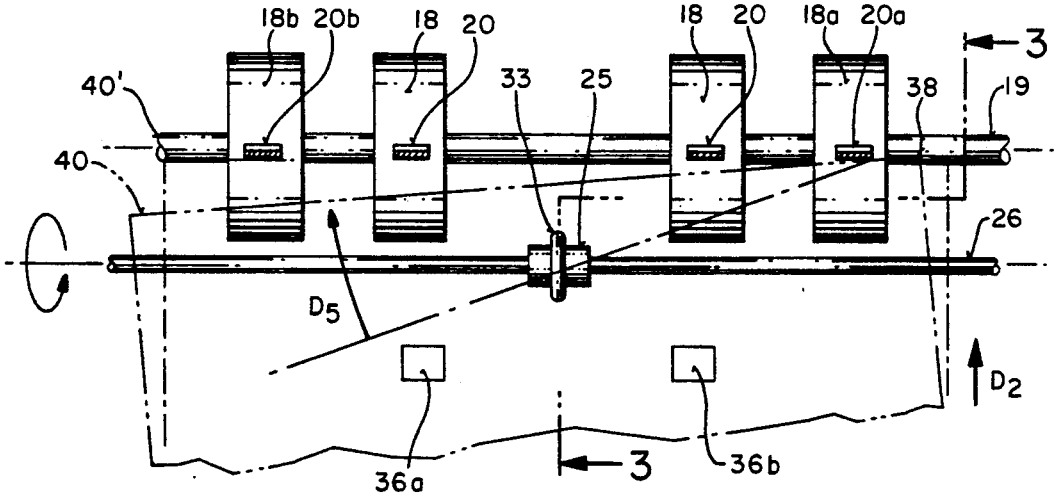
FIG. 2 is a front view of the present invention.

As shown in FIG. 2, a sensor, or preferably, a plurality of sensors **36*a* and 36*b*, are provided to detect the presence, and if necessary the proper positioning of paper in the printer. The sensors initiate the activation of the pinch drive rollers 25. The sensors 36*a* and 36*b* are preferably electric eyes for detecting a change in available light when covered by a piece of paper, as is known and used in the art and for sending a signal to the motor 32 to active the motor. Two sensors are preferably provided to ensure that the paper is sufficiently centered in the printer so that the pinch roller 25** will be able to drive the paper when installed therein and deliver it to the center two nips.

OPERATION

When paper 12 is inserted into the present invention viewed as shown in FIGS. 1 and 2 it passes sensors **36*a* and 36*b* which detect the presence of the paper and activate motor 32 to rotate shaft 26 in direction $D_1$ which in turn rotates pinch drive roller 25. Paper 12 is transported by pinch drive roller 25 and second pinch roller 30 in direction $D_2$ toward main drive rollers 18. When the first side 38 of the leading edge of paper 12 abuts the nip defined by the main drive roller 18*a* and spring finger 20*a* it stops. The pinch roller 25, encountering resistance on the first side of the paper and less resistance on the other side 40 of the paper, forces side 40 down in direction $D_5$ toward the nip defined by roller 18*b* and spring finger 20*b* to become side 40'. After side 40' stops, the drive pinch roller 25 stalls as a result the resistance without bunching paper 12**. After a specified period of time after the pinch roller is activated, approximately 2 seconds in the preferred embodiment, although it can be substantially shorter or longer time, as will be appreciated by a person of ordinary skill in the art, the drive roller is activated.

The pinch roller continues to drive, although it is stalled by the pressure, until shortly after the main drive roller 18 is activated, and then it is deactivated. Alternatively a sensor can be provided to indicate when the paper is passed a certain point past the nip. At that point in the operation of the present invention, the pinch roller is idle and the drive roller takes over transporting the paper through the printer.

It will be obvious to a person of ordinary skill in the art that many changes and modifications can be made to the above-described system which will fall within the spirit and scope of the invention as set forth in the appended claims.

What is claimed is:

1. A registration system for a printer having main drive rollers and drive roller engaging means defining a nip in registration with a print means comprising:

a print media drive roller disposed solely on a shaft in advance of said nip near the center thereof and abutting a print media disposed therein in use; and a low-torque drive means to rotate said print media drive roller without substantially damaging the integrity of the print media when the print media is forced against the nip thereby.

2. The registration system of claim 1 wherein said drive roller engaging means comprises spring fingers.

3. The registration system of claim 1 wherein said low-torque drive means for rotating said print media drive roller has a stall force of approximately 4 ounces.

4. The registration system of claim 1 further comprising means for actuating said print media drive roller.

5. The registration system of claim 4 further comprising a drive roller actuating means interactive with said print media drive roller for actuating said main driver rollers in response to a condition of said print media drive roller.

6. The registration system of claim 4 wherein said means for actuating said print media drive roller comprises at least one sensor means for detecting said print media in said system and sending a signal to said print media drive roller actuating said print media drive roller.

7. The registration system of claim 6 wherein said means for engaging said print media drive roller comprises a plurality of sensors disposed in the path of the print media prior to said print media drive roller.

8. The registration system of claim 6 wherein at least two of said main drive rollers are disposed approximately equidistant from the center of said nip, and wherein said plurality of sensors further comprise two sensors, one sensor disposed adjacent and prior to each of said two main drive rollers.

9. The registration system of claim 1 further comprising means for deactuating said print media drive roller.

10. The registration system of claim 9 wherein said means for deactuating said print media drive roller comprises a sensor for detecting the position of the print media disposed adjacent the path of the print media and after the nip.

11. The registration system of claim 9 wherein said means for deactuating said print media drive roller comprises a timing means for deactuating said print media drive roller a predetermined time after said print media drive roller is actuated.

12. The registration system of claim 1, wherein said print media drive roller is disposed at a midpoint of the nip.

13. The registration system of claim 2 wherein said spring fingers engage said main drive rollers at approximately a 45° angle.

14. A registration system for a read and/or write device having a drive roller for transporting media through said device and a drive roller engaging means forming a nip perpendicular to the path of transport of said media, said system comprising:

a media drive roller disposed solely on a shaft in advance of said nip near the center thereof and abutting said media when disposed therein in use;

a low-torque drive means to rotate said media drive roller without substantially damaging the integrity of the media when the media is forced against the nip thereby; and means for actuating said drive means;

means for deactuating said drive means; and means for actuating said drive roller.

15. Method of registering paper in a printer comprising the steps of:

inserting the leading edge of a piece of paper into a printer;

actuating a first paper drive roller disposed solely on a shaft near the center of the leading edge of said paper and in advance of a nip in said printer comprising a second paper drive means and second paper drive means engaging means, said first drive roller being in contact with said piece of paper;

allowing said paper to abut said nip with at least a portion of said leading edge and driving said paper forward until the entire leading edge thereof is adjacent said nip;

actuating said second drive means to transport said piece of paper into said printer; and deactuating said first paper drive roller.

16. The method of claim 15 wherein said first paper drive roller is actuated for a predetermined amount of time, said second paper drive means is actuated while said first paper drive roller remains actuated, and said first paper drive roller is deactuated after said second paper drive means is actuated a predetermined amount of time.

17. The method of claim 15 wherein said first paper drive roller is actuated for a predetermined amount of time, said second paper drive means is actuated while said first paper drive roller remains actuated, and said first paper drive roller is deactuated after the paper is transported to a predetermined position.

18. A registration system for a printer having main drive rollers and drive roller engaging means defining a nip in registration with a print means comprising:

a single drive pinch roller disposed solely on a shaft in advance of said nip located at a midpoint thereof and abutting print media disposed therein during use; and a low-torque drive means to rotate said single drive pinch roller without substantially damaging the integrity of the print media when the print media is forced against the nip thereby.

* * * * *